US006280565B1

(12) United States Patent
Underwood

(10) Patent No.: US 6,280,565 B1
(45) Date of Patent: Aug. 28, 2001

(54) LABEL GUN

(76) Inventor: Robert H. Underwood, 2138 Cherry Hill Church Rd., South Boston, VA (US) 24592

( * ) Notice: Subject to any disclaimer, the term of this patent is extended or adjusted under 35 U.S.C. 154(b) by 0 days.

(21) Appl. No.: 09/344,383

(22) Filed: Jun. 24, 1999

Related U.S. Application Data

(60) Provisional application No. 60/091,779, filed on Jul. 6, 1998.

(51) Int. Cl.[7] ..... B65C 9/00

(52) U.S. Cl. ..... 156/577; 156/574; 156/579

(58) Field of Search ..... 156/574, 577, 156/579, 384, 542, 538, 539, 540

(56) References Cited

U.S. PATENT DOCUMENTS

| | | | |
|---|---|---|---|
| 3,440,123 | | 4/1969 | Hamisch, Sr. . |
| 4,111,735 | | 9/1978 | Hamisch, Jr. . |
| 4,116,746 | | 9/1978 | Hamisch, Jr. . |
| 4,758,303 | * | 7/1988 | Shastko ..... 156/542 |
| 4,985,110 | | 1/1991 | Becker . |
| 4,986,874 | | 1/1991 | Kawada . |
| 5,013,390 | | 5/1991 | Hermann . |

FOREIGN PATENT DOCUMENTS

| | | |
|---|---|---|
| 2123598 | 11/1972 | (DE) . |
| 2512471 | 9/1976 | (DE) . |
| 2008070 | 5/1979 | (GB) . |
| 46-32984 | 9/1971 | (JP) . |
| WO 88/07960 | 10/1988 | (WO) . |

* cited by examiner

*Primary Examiner*—Richard Crispino
*Assistant Examiner*—Cheryl N. Hawkins
(74) *Attorney, Agent, or Firm*—Richard C. Litman

(57) ABSTRACT

The invention is a label gun having a front handle with a curved top surface, the rear portion of the curved surface having a high coefficient of friction. When the front handle is pulled back, the rear portion of the curved surface comes in contact with the backing paper, thereby pulling the labels towards the dispenser. A threaded screw may be used to vary the spring compression for the front handle, thereby varying the distance over which a label is dispensed, and hence being suitable for variously sized labels. The label gun also includes a plurality of elongated, flexible fingers adjacent to the dispenser, which provide even pressure to a label when attaching it to a curved or irregular surface.

19 Claims, 7 Drawing Sheets

LABEL GUN

CROSS-REFERENCE TO RELATED APPLICATION

This application claims the benefit of U.S. Provisional Patent Application Ser. No. 60/091,779, filed Jul. 6, 1998.

BACKGROUND OF THE INVENTION

1. Field of the Invention

The present invention relates to devices for dispensing adhesively backed labels. Specifically, the invention is a label gun for applying labels to curved or irregular surfaces.

2. Description of Related Art

Several different inventors have developed various improvements to label guns. Such improvements include means for ensuring that the label gun properly dispenses labels of varying lengths, means for printing information on a label as it is dispensed, means for protecting a label gun from damage if dropped, and means for applying labels to angled surfaces. To the current inventor's knowledge, no one has developed a label gun suitable for applying labels to curved surfaces, around corners, or on other irregular surfaces. Additionally, many other label guns are significantly more complex—and consequently expensive to produce —than the current invention.

U.S. Pat. No. 3,440,123, issued to Paul H. Hamisch, Sr. on Apr. 22, 1969, describes one example of a label gun which dispenses labels having a glassine paper backing strip. The labeler has a printing head comprising a series of bands which can be rotated to change the character being printed in a given location. The labeler is operated by squeezing a movable handle towards a fixed handle, which moves a drive wheel lined with a material having a high coefficient of friction. The labeler includes a series of fingers biased to drop into notches on the backing, taking the drive wheel out of contact with the label strip.

U.S. Pat. No. 4,111,735, issued to Paul H. Hamisch, Jr. on Sep. 5, 1978, describes a labeler having an applicator which deflects when the labeler is dropped on the applicator, preventing damage to the labeler.

Paul H. Hamisch, Jr. attempted to improve the ability of label guns to apply labels to angled surfaces, as described in U.S. Pat. No. 4,116,746, issued on Sep. 26, 1978. This labeler has an applicator roll providing for both rolling and canting movement so that it will conform to the surface to which the label is applied. Unlike the current invention, it can not accommodate irregular or curved surfaces.

Other inventors also attempted to provide label guns allowing for different size labels. U.S. Pat. No. 4,985,110, issued to Werner Becker on Jan. 15, 1991, describes a labeler having a printing mechanism. The labeler can accommodate labels of different sizes by varying the diameter of the pinion engaging the transport roll, or by an adjustable lug on the operating handle. U.S. Pat. No. 4,986,874, issued to Toshikaru Kawada on Jan. 22, 1991, describes a labeler having a feeler and lever stop to allow for different length labels. When the feeler pushes up against the forward edge of a label, the lever stop tilts. Both designs are significantly more complicated and expensive than the operational design used in the current invention.

U.S. Pat. No. 5,013,390, issued to Klaus-Dieter Hermann on May 7, 1991, describes a labeler having a tape brake pressing against the tape when the operating lever is in its rest position, releasing the tape as the operating lever is released. The same invention appears to be described in international application WO 88/07960, filed by the same inventor, and published on Oct. 20, 1988.

U.K. Pat. App. No. 2,008,070, published on May 31, 1979, describes a labeler having a printer which is slightly rockable to improve contact with the label, and which completely separates the label from the backing before applying the label to the desired surface, preventing pulling on the backing.

Related international patents include Japanese Pat. No. 4632984, published in Sep. 1971, German Pat. No. 2,123, 598, published on Nov. 16, 1972, and German Pat. No. 2,512,471, published on Sep. 30, 1976.

None of the above patents describes a label gun having the simplicity of the current invention, or the ability of the current invention to apply labels to irregular or curved surfaces.

None of the above inventions and patents, taken either singly or in combination, is seen to describe the instant invention as claimed.

SUMMARY OF THE INVENTION

The current invention is a label gun with a far simpler actuation means than any other label gun known to the inventor, and which is capable of applying labels of varying lengths to curved or irregular surfaces. The invention includes a label storage area, a dispenser, a plurality of flexible fingers next to the dispenser, a slidable front handle and fixed rear handle.

The labels for the current invention are stored inside the housing on top of the label gun. The housing has a clear top to allow the user to view the labels as they are dispensed, ensuring that the user can dispense the proper length of label. The labels are preferably stored in a roll. The side walls of the housing may include a rod or shaft passing through the center of the roll, and attached to one side wall for centering the roll of labels. Alternatively, a pair of convex bubbles opposite each other may be used.

The dispensing unit comprises a rounded surface at the front end of the label gun having a small radius. A typical sheet of backing paper is flexible enough to travel around the small radius, but a typical label is too rigid to do so. The label will therefore separate from the backing paper when the backing paper is pulled around the small radius dispenser. The label can then be pressed against the desired surface using the plurality of flexible fingers located adjacent to the dispenser.

The backing paper continues back through the label gun, passing adjacent to the tops of the front and rear handles. The rear handle's location is fixed. The front handle is slidably movable along the length of the bottom of the label gun's housing, and is biased towards the forward position. The top of the front handle is elongated and flat. The rear portion of this flat surface is preferably elevated and preferably has a high coefficient of friction. When the front handle is pulled rearward, this rear surface engages the backing paper, pulling the labels to the dispenser. When the trigger slides forward, the front portion of the top surface engages the backing paper. The front surface is slightly lower than the rear surface, and does not have a coefficient of friction sufficiently high to move the backing paper.

Ideally, a foam rubber member will press against the backing paper with sufficient force to prevent undesired movement of the backing paper, but insufficient force to overcome the rearward movement caused by pulling the front handle.

If the means of biasing the front handle in the forward position is a spring, a threaded rod can be used to vary the compression of the spring, thereby limiting the front handle's distance of possible movement to the length of the labels currently being used. Alternatively, if the top of the housing is transparent, the user can watch the labels being dispensed, thereby pulling the front handle only the appropriate distance to dispense a label.

Accordingly, it is a principal object of the invention to provide a label gun capable of applying labels to curved and irregular surfaces, by applying pressure over the entire surface of a label engaging such a surface.

It is another object of the invention to provide a label gun capable of applying labels of varying sizes.

It is a further object of the invention to provide a label gun with a significantly simpler and more inexpensive operating mechanism than other currently existing label guns.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
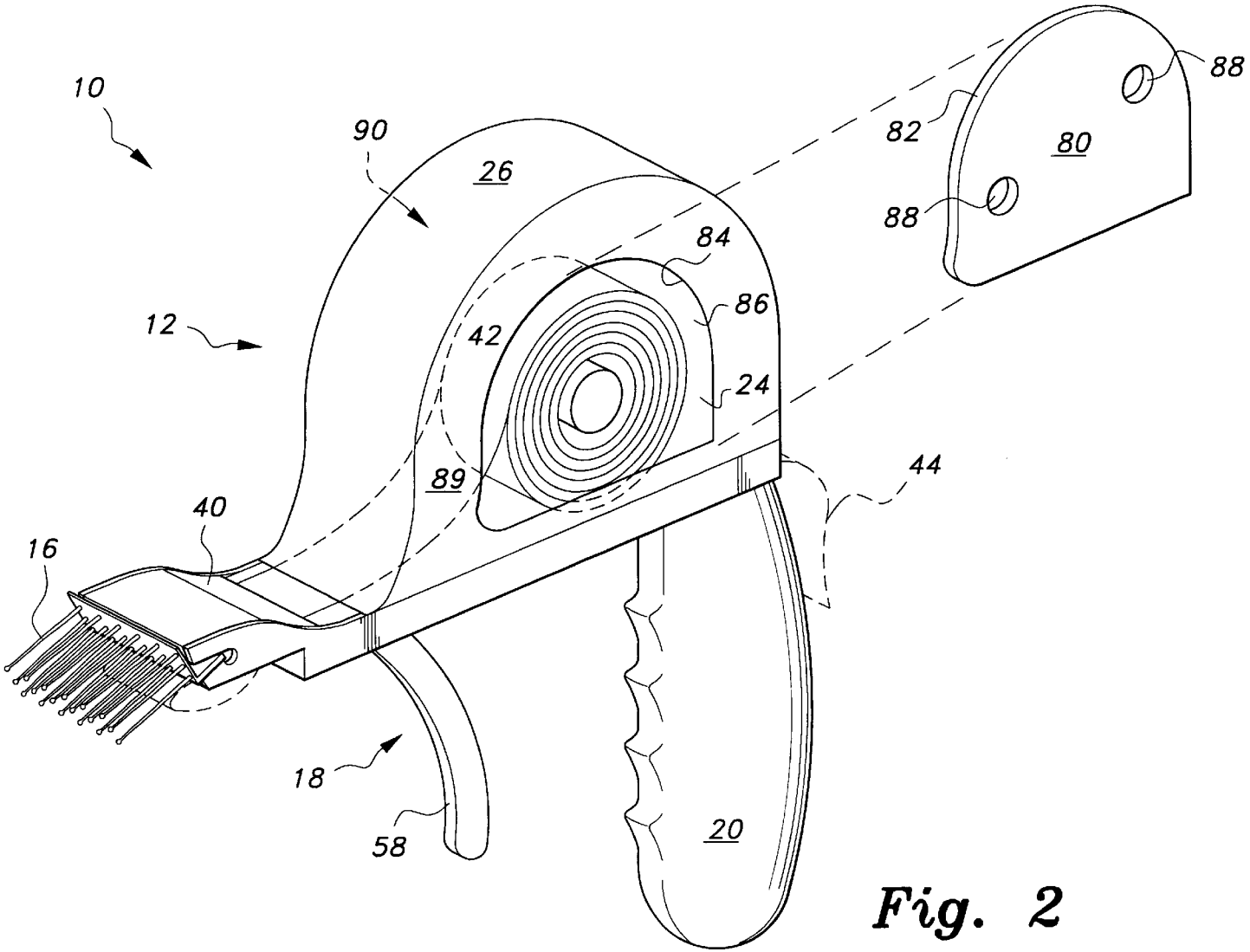
FIG. 2 is a perspective view of a label gun according to the current invention, showing the label compartment's cover open for adding labels.
Figure 3:
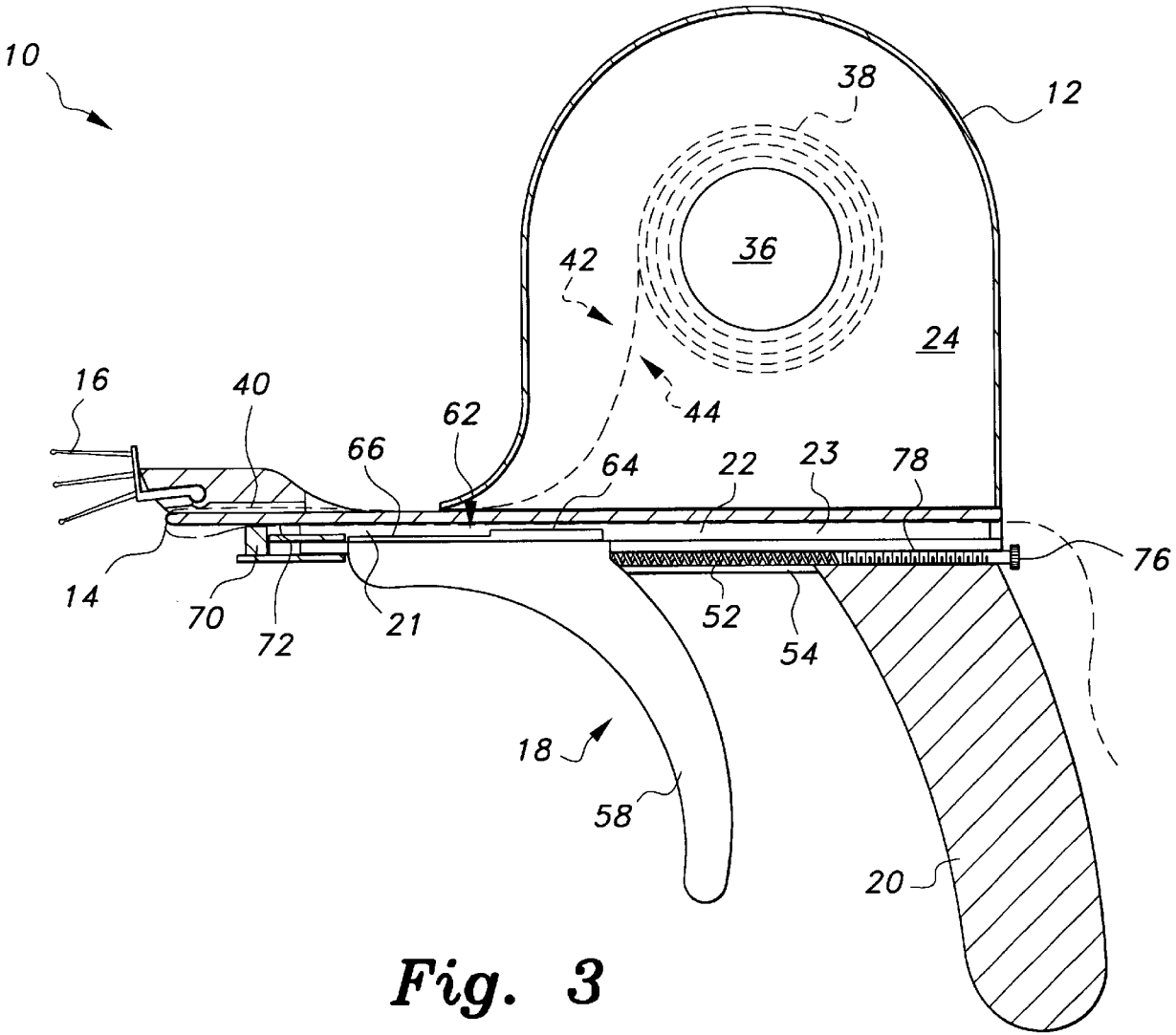
FIG. 3 is a side cross sectional view of a label gun according to the present invention.

The present invention is an improved label gun for dispensing labels having an elongated, flexible backing. Referring to FIGS. 2–3, the label gun 10 comprises a housing 12, a dispenser 14, a plurality of elongated, flexible fingers 16 adjacent to said dispenser, a slidably movable front handle 18, a fixed rear handle 20, and a longitudinal guide channel 22.

Figure 5:
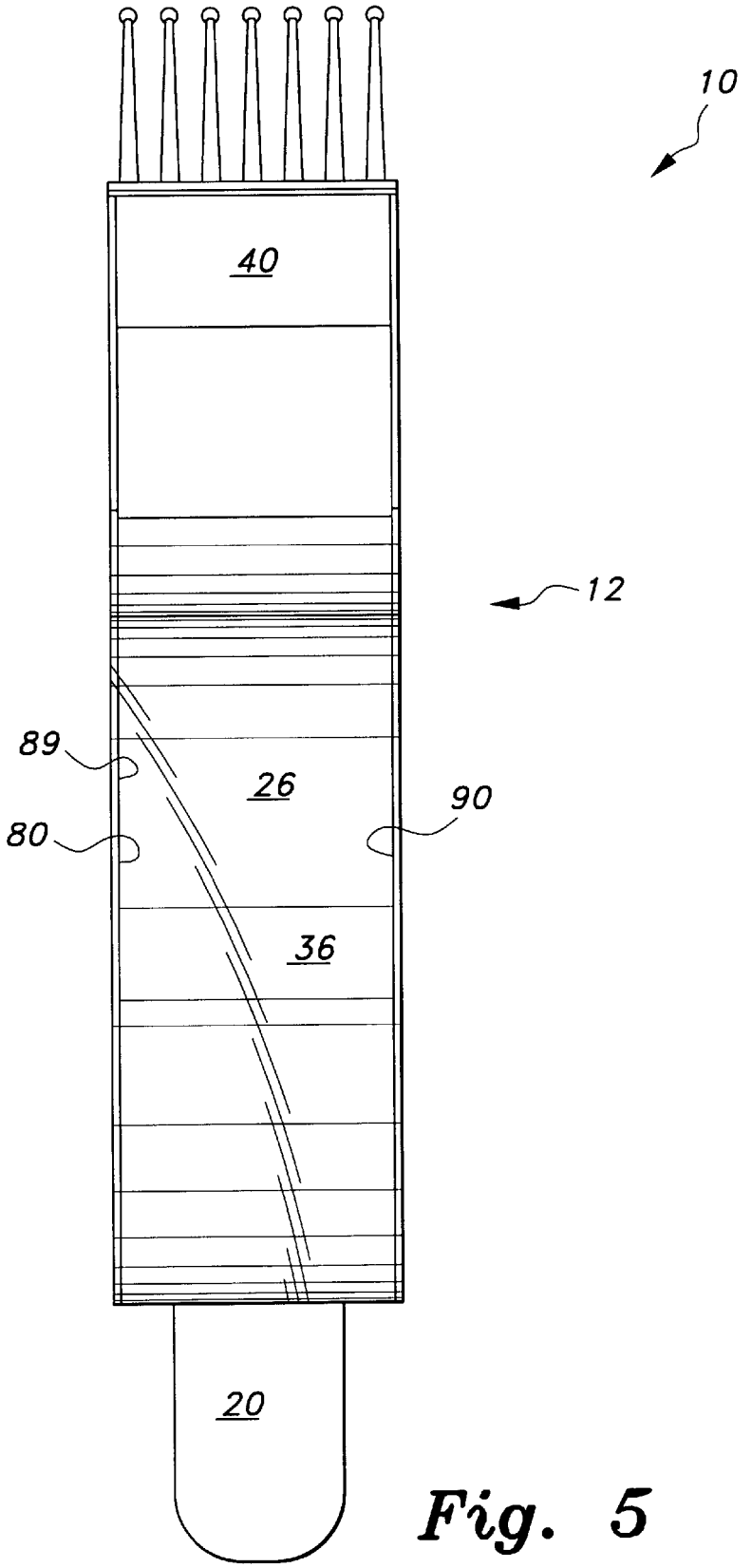
FIG. 5 is a top perspective view of a label gun according to the present invention.

The housing includes a label storage area 24 at the top rearmost portion having two substantially parallel sides 89,90 and a top 26. The top 26 of this label storage area 24 is transparent. The label storage area must include a means for accessing the storage area. As illustrated in FIG. 2, the label storage area 24 can be accessed by removing a side door 80 within side 89. The side door 80 may be secured in place using any of several means which are well known to those skilled in the art, with a preferred and suggested means being friction between its side edges 82 and the side edges 84 of the access opening 86. The door 80 may preferably be removed by grasping it through finger holes 88. With the door 80 removed, a roll of labels 38 may be placed inside the storage area 24. Preferably, the storage area will include means for holding a roll of labels 38. A preferred and suggested means is a horizontal shaft 36 within storage area 24. The horizontal shaft 36 is secured to the side 90 opposite opening 86 (FIG. 5).

Figure 6:
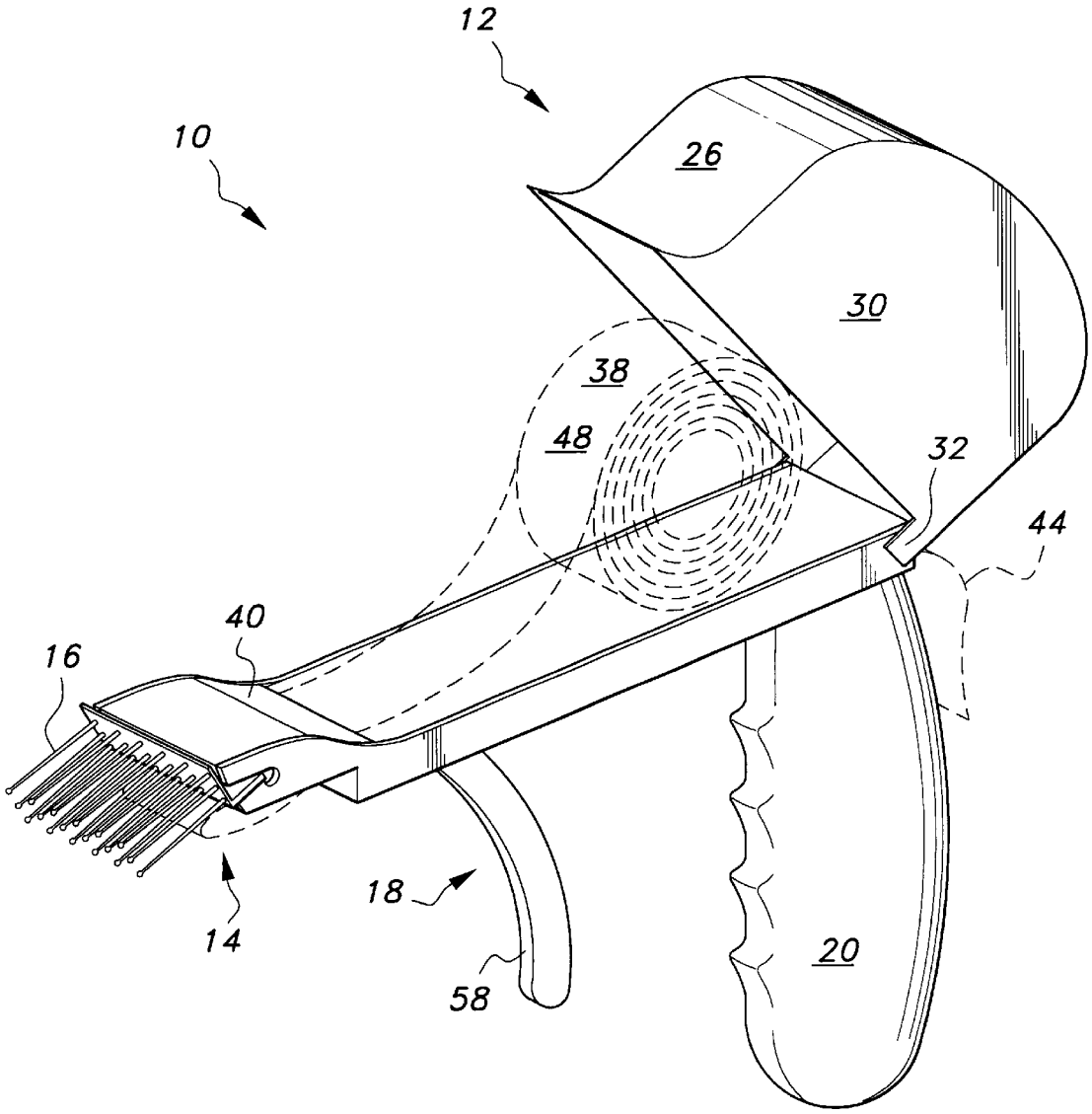
FIG. 6 is a perspective view of a second embodiment of a label gun according to the current invention, showing the label compartment's cover open for adding labels.
Figure 7:
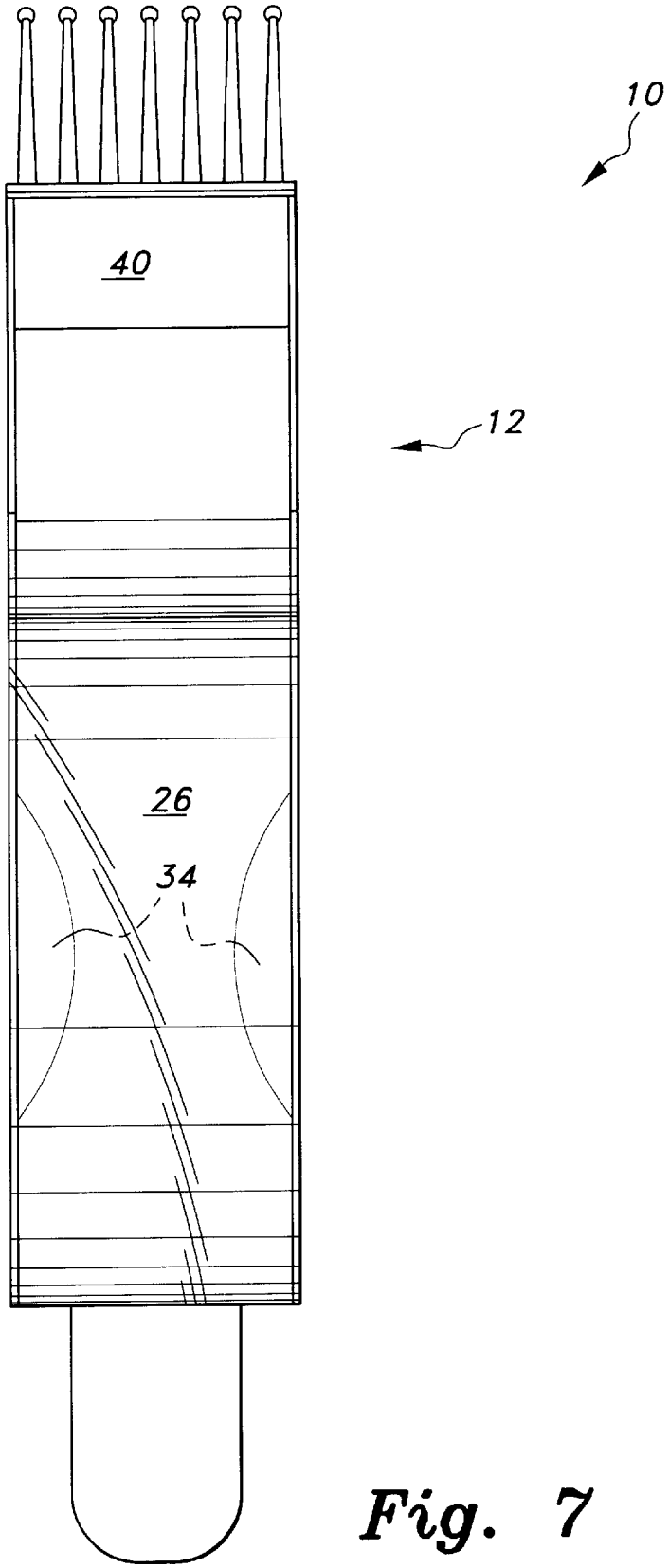
FIG. 7 is a top perspective view of a label gun according to the present invention.

Alternatively, the label storage area 24 can be accessed by rotating the housing top 30 rearward on hinge 32, as shown in FIG. 6. Referring to FIGS. 6 and 7, the means for holding the roll of labels 38 within the label storage area 24 may include a pair of convex bubbles 34 for centering a roll of labels 38 within the storage area. Although some means for holding the roll of labels 38 within the storage area 24 is part of the preferred embodiments, the label gun will function without convex bubbles 34 or shaft 36.

Located in front of the storage area 24 is feed path 40, along which labels 42, on backing paper 44, are pulled towards dispenser 14. Dispenser 14 is a rounded surface at the front of the label gun, having a small radius. A plurality of elongated, flexible fingers 16 is located directly above dispenser 14.

Figure 4:
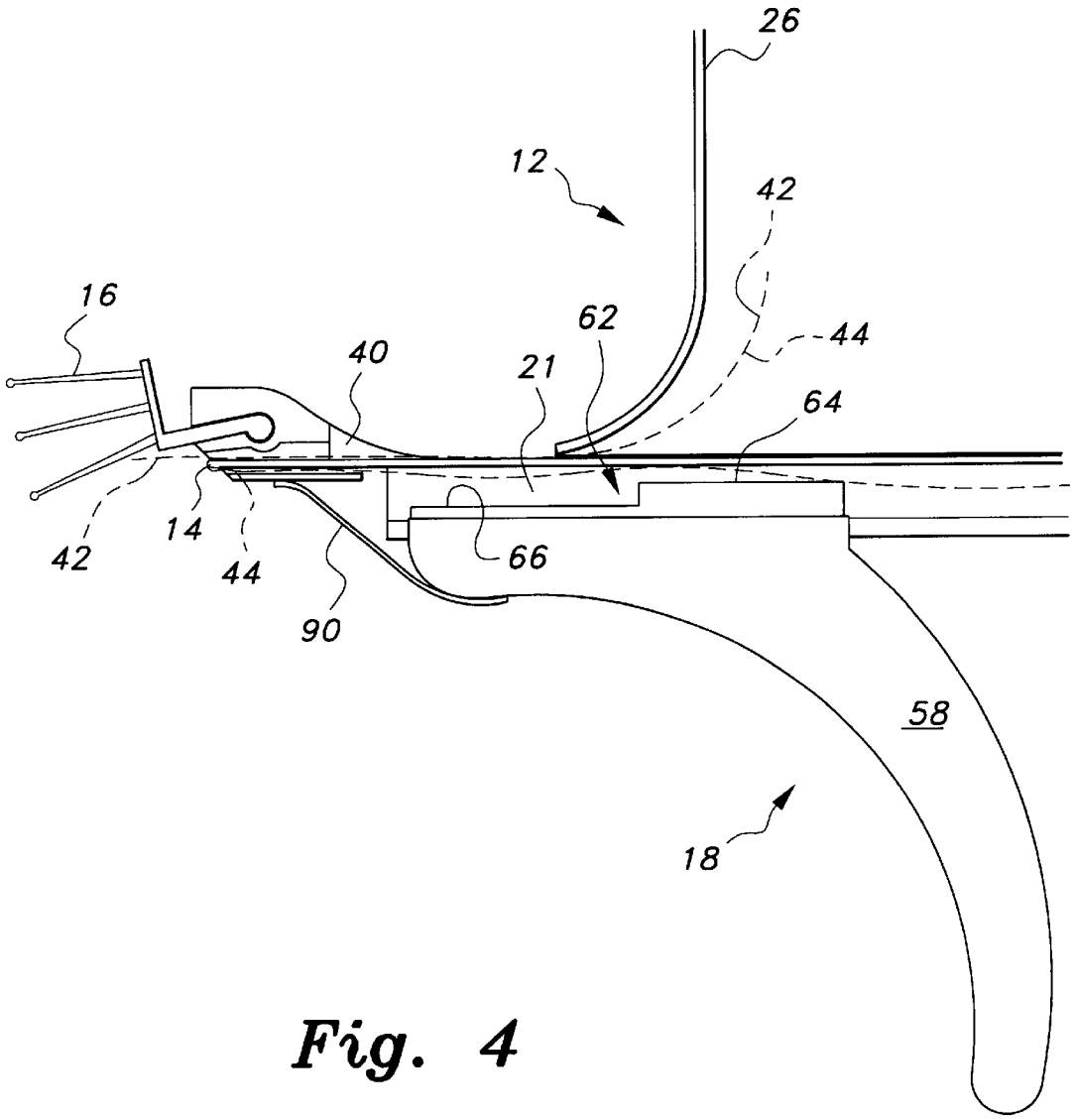
FIG. 4 is a side cross sectional view of the sliding front handle actuation device of a label gun according to the present invention.

The bottom of housing 12 includes rear handle 20, and longitudinal guide channel 22. The longitudinal guide channel 22 has a front end 21 and a rear end 23, with the rear end 23 being adjacent to rear handle 20. The front handle 18 comprises trigger 58 and a flat, elongated top portion 62, which is best shown in FIG. 4. The top portion 62 of front handle 18 is dimensioned and configured to reciprocate within longitudinal guide channel 22 between a first position at the longitudinal guide channel's front end, and a rear position adjacent to the rear handle 20. Referring back to FIG. 3, the rear surface portion 64 of top surface 62 is slightly elevated, and has a high coefficient of friction. This high coefficient of friction can be achieved by attaching sand paper or rubber to surface 64, or by roughening surface 64. The front surface portion 66 of top surface 62 is slightly lower than rear surface portion 64, and has a low coefficient of friction. Curved surface 62 and backing paper 44 are contained within longitudinal guide channel 22, with trigger 58 extending below the housing 12.

The label gun 10 includes a means for biasing the front handle 18 in its forward position. Preferred and suggested means include a spring 52, located within a spring guide channel 54, parallel to longitudinal guide channel 22. FIG. 4 shows an alternative means of biasing front handle 56 in the forward position. Resilient band 90 is attached to front handle 18 and housing 12, performing the same function as spring 68 in the above-described embodiment.

A backing retainer 70 made from a resilient material such as foam rubber is located in longitudinal guide channel 22, in front of front handle 18. Backing retainer 70 presses backing paper 44 against top 72 of longitudinal guide channel 22. Used backing paper 44 exits the label gun behind rear handle 50.

Referring to FIGS. 2, 3, and 6, the roll of labels 38 is placed in the label gun 10 by removing the side door 80, or by rotating the housing top 30 rearward on hinge 32. The roll of labels 38 is placed on shaft 36, or between convex bubbles 34. Labels 42 and backing paper 44 are then passed through the feed path 40. Backing paper 44 is passed around dispenser 14 and through longitudinal guide channel 52.

Figure 1:
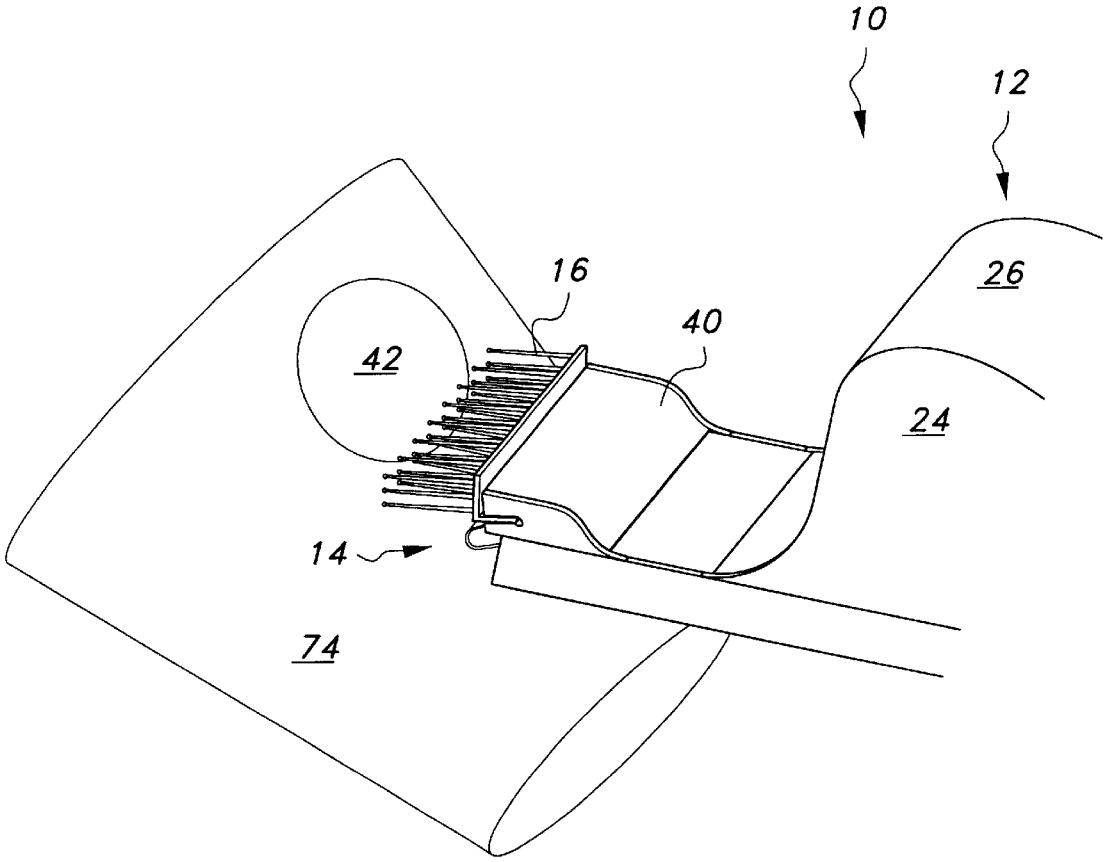
FIG. 1 is a environmental, partial perspective view of a label gun according to the present invention being used to apply a label to a curved surface.

Referring to FIGS. 1 and 3, label gun 10 is used by holding rear handle 50, positioning label gun 10 adjacent to the object to be labeled 74, and pulling front handle 18 rearward from its front position to its rear position. Pulling front handle 18 rearward brings the elevated rear surface portion 64 upward into contact with backing 44, allowing handle 56 to pull backing 44 rearward. Backing 44 pulls labels 42 and additional backing 44 through feed path 40, and around dispenser 14. Backing 44 is flexible enough to bend around the small diameter of dispenser 14, but labels 42 do not, in part due to the releasable interaction of the adhesive surface of the labels and its release liner backing. Labels 42 therefore separate from backing 44 overcoming adhesion forces between the backing and the label. Fingers 16 are pressed against the label, which is in turn pressed against the object to be labeled 74, causing it to adhere to the desired surface. As the front handle is released, it is biased forward by spring 52. The rear surface portion 64 is now moved away from backing 44, and the front surface portion 66 is moved towards the backing 44. However, because front surface portion 66 is slightly lowered with respect to rear surface portion 64, front surface portion 66 does not make contact with the backing 44, preventing the front handle 18 from pushing the backing 44 forward.

Object 74 in FIG. 1 is a cup having a rounded, tapered surface. A flat roller as is typically used on label guns would be unable to press the label 42 against cup 74. However, fingers 16, each of which can bend individually to the necessary degree, apply pressure over entirety of label 42, causing it to adhere to many curved or irregular surfaces.

The user can determine how far to pull front handle 56 by watching the labels through transparent top 26. Alternatively, threaded rod 76 may be inserted into threaded hole 78, which is coaxial with spring guide channel 54. Tightening threaded rod 76 compresses spring 52, limiting the distance the front handle 56 can travel to the length of a label.

It is to be understood that the present invention is not limited to the sole embodiments described above, but encompasses any and all embodiments within the scope of the following claims.

I claim:

1. A label gun for dispensing labels, said labels having an elongated backing stored on a roll, said label gun comprising:

a housing, comprising:

a label storage area having two substantially parallel sides and a top;

a dispenser having a rounded surface with a small radius;

a label feed path between said label storage area and said dispenser;

a longitudinal guide channel having a front end, a rear end, and a pair of substantially parallel sides and a top surface;

a rear handle attached at said longitudinal guide channel's rear end;

a front handle having an elongated trigger portion, and a top portion, said top portion having a flat rear surface portion and a flat front surface portion, said rear surface portion being elevated with respect to said front surface portion, said rear surface portion having a high coefficient of friction, said top portion being located within said longitudinal guide channel, said front handle being slidably movable between a forward position at said longitudinal guide channel's front end, and a rear position adjacent to said rear handle; and means for biasing said front handle in said forward position.

2. The label gun according to claim 1, further comprising a plurality of elongated flexible fingers at said front end, adjacent to said dispenser.

3. The label gun according to claim 1, further comprising a backing retainer made from a resilient material, located at said front portion between said front handle and said dispenser, biasing the label's backing towards said longitudinal guide channel's top surface.

4. The label gun according to claim 1, wherein said means for biasing said front handle in said forward position comprises:

a spring guide channel located at said housing's bottom portion, substantially parallel to said longitudinal guide channel, extending between said front handle's forward position and said rear handle; and a spring within said channel.

5. The label gun according to claim 4, further comprising:

a threaded hole at said housing's rear portion, coaxial with said spring guide channel; and a threaded rod within said threaded hole.

6. The label gun according to claim 1, wherein said means for biasing said front handle in said forward position comprise a resilient band.

7. The label gun according to claim 1, further comprising means for holding said labels within said storage compartment.

8. The label gun according to claim 7, wherein said means for holding said labels within said storage compartment comprise a shaft secured to one of said parallel sides of said storage area.

9. The label gun according to claim 7, wherein said means for holding said labels within said storage compartment comprise a pair of convex bubbles, each of said convex bubbles corresponding to one of said pair of parallel sides of said storage area.

10. The label gun according to claim 1, wherein said label storage area's top surface is transparent.

11. A label gun for dispensing labels having an elongated backing and stored on a roll, comprising:

a housing including:

a label storage area having two substantially parallel sides and a top;

a dispenser having a rounded surface with a small radius;

a label feed path between said label storage area and said dispenser;

a longitudinal guide channel having a front end, a rear end, and a pair of substantially parallel sides and a top surface;

a plurality of elongated flexible fingers at said front end, adjacent to said dispenser;

a rear handle attached at said longitudinal guide channel's rear end;

a front handle having an elongated trigger portion, and a top portion, said top portion having a flat rear surface portion and a flat front surface portion, said rear surface portion being elevated with respect to said front surface portion, said rear surface portion having a high coefficient of friction, said top portion being located within said longitudinal guide channel, said front handle being slidably movable between a forward position at said longitudinal guide channel's front end, and a rear position adjacent to said rear handle; and means for biasing said front handle in said forward position.

12. The label gun according to claim 11, further comprising a backing retainer made from a resilient material, located at said front portion between said front handle and said dispenser, biasing the label's backing towards said longitudinal guide channel's top surface.

13. The label gun according to claim 11, wherein said means for biasing said front handle in said forward position comprises:

a spring guide channel located at said housing's bottom portion, substantially parallel to said longitudinal guide channel, extending between said front handle's forward position and said rear handle; and a spring within said channel.

14. The label gun according to claim 13, further comprising:

a threaded hole at said housing's rear portion, coaxial with said spring guide channel; and a threaded rod within said threaded hole.

15. The label gun according to claim 11, wherein said means for biasing said front handle in said forward position comprise a resilient band.

16. The label gun according to claim 11, further comprising means for holding said labels within said storage compartment.

17. The label gun according to claim 16, wherein said means for holding said labels within said storage compartment comprise a shaft secured to one of said parallel sides of said storage area.

18. The label gun according to claim 16, wherein said means for holding said labels within said storage compartment comprise a pair of convex bubbles, each of said convex bubbles corresponding to one of said pair of parallel sides of said storage area.

19. The label gun according to claim 11, wherein said label storage area's top surface is transparent.

* * * * *